US006452107B1

(12) United States Patent
Kebabjian

(10) Patent No.: US 6,452,107 B1
(45) Date of Patent: Sep. 17, 2002

(54) MULTIPLE PAIR, HIGH SPEED DATA TRANSMISSION CABLE AND METHOD OF FORMING SAME

(75) Inventor: Matthew T. Kebabjian, Jacksonville, FL (US)

(73) Assignee: Tensolite Company, St. Augustine, FL (US)

( * ) Notice: Subject to any disclaimer, the term of this patent is extended or adjusted under 35 U.S.C. 154(b) by 0 days.

(21) Appl. No.: 09/709,622

(22) Filed: Nov. 10, 2000

(51) Int. Cl.[7] ..... H01B 7/00; H01B 7/34

(52) U.S. Cl. ..... 174/113 R; 174/36

(58) Field of Search ..... 174/113 C, 110 R, 174/110 FC, 113 R, 115, 117 R, 36, 190 SR, 116, 117 F, 117 AS, 117 FF

(56) References Cited

U.S. PATENT DOCUMENTS

| | | | | | |
|---|---|---|---|---|---|
| 220,944 | A | | 10/1879 | Rogers et al. | |
| 290,122 | A | | 12/1883 | Shaw | |
| 1,795,209 | A | * | 3/1931 | Haugwitz | |
| 2,454,625 | A | | 11/1948 | Bondon | |
| 2,941,911 | A | | 6/1960 | Kumnick et al. | |
| 3,616,177 | A | | 10/1971 | Gumerman | 161/165 |
| 3,617,617 | A | | 11/1971 | Katz | 174/120 |
| 3,627,624 | A | | 12/1971 | Kreuz | 161/165 |
| 3,642,569 | A | | 2/1972 | Gerow | 161/189 |
| 3,676,566 | A | | 7/1972 | McBride | 174/36 |
| 3,770,566 | A | | 11/1973 | Gerow et al. | 161/189 |
| 3,770,573 | A | | 11/1973 | Dunphy et al. | 161/227 |
| 3,867,564 | A | * | 2/1975 | Kardashian | 174/36 |
| 4,096,346 | A | | 6/1978 | Stine et al. | 174/36 |
| 4,184,001 | A | | 1/1980 | Hildreth | 428/383 |
| 4,273,829 | A | | 6/1981 | Perreault | 428/383 |
| 4,515,993 | A | | 5/1985 | MacKenzie | 174/102 R |
| 4,628,003 | A | | 12/1986 | Katz | 428/377 |
| 4,719,319 | A | * | 1/1988 | Tighe, Jr. | 174/103 |
| 4,820,175 | A | | 4/1989 | Hasegawa et al. | 439/98 |
| 4,965,412 | A | | 10/1990 | Lai et al. | 174/107 |
| 5,106,673 | A | | 4/1992 | Effenberger et al. | 428/216 |
| 5,142,100 | A | * | 8/1992 | Vaupotic | 174/24 |
| 5,216,202 | A | * | 6/1993 | Yoshida et al. | 174/36 |
| 5,220,133 | A | | 6/1993 | Sutherland et al. | 174/120 R |
| 5,260,413 | A | | 11/1993 | Ochsner et al. | 528/353 |
| 5,329,064 | A | * | 7/1994 | Tash et al. | 174/36 |
| 5,380,820 | A | | 1/1995 | Ohta et al. | 528/353 |
| 5,399,434 | A | | 3/1995 | Katz et al. | 428/421 |
| 5,483,020 | A | * | 1/1996 | Hardie et al. | 174/36 |
| 5,510,578 | A | * | 4/1996 | Dunlavy | 174/128.1 |
| 5,552,565 | A | * | 9/1996 | Cartier et al. | 174/117 F |
| 5,574,250 | A | | 11/1996 | Hardie et al. | 174/36 |
| 5,731,088 | A | | 3/1998 | LaCourt | 428/421 |
| 5,767,442 | A | * | 6/1998 | Eisenberg et al. | 174/36 |
| 6,005,193 | A | | 12/1999 | Markel | 174/117 FF |
| 6,010,788 | A | * | 1/2000 | Kebabjian et al. | 428/381 |

* cited by examiner

*Primary Examiner*—Dean A. Reichard
*Assistant Examiner*—William H. Mayo, III
(74) *Attorney, Agent, or Firm*—Wood, Herron & Evans, L.L.P.

(57) ABSTRACT

A high speed data transmission cable includes a plurality of primary cables, wherein each primary cable includes a pair of generally parallel, insulated conductors, and has opposing short sides and opposing long sides. A shield layer surrounds each primary cable along its length to individually electrically isolate the primary cables from each other. The plurality of primary cables are positioned around a cable center axis with finite numbers of primary cables arranged side-by-side with each other to define distinct orbitals around the center axis. The primary cables of the orbitals have a respective long side generally facing radially inwardly toward the center axis. The primary cables of the orbitals are wrapped generally helically around the center axis along the length of the cable without each primary cable conductor pair being significantly individually twisted about each other along the cable length.

45 Claims, 2 Drawing Sheets

MULTIPLE PAIR, HIGH SPEED DATA TRANSMISSION CABLE AND METHOD OF FORMING SAME

FIELD OF THE INVENTION

This invention relates generally to data transmission cables and more specifically to a high speed data transmission cable which has multiple primary cable pairs combined together into a larger cable structure.

BACKGROUND OF THE INVENTION

There is currently a demand for high speed data transmission cables which are capable of high-fidelity data signal transmission at minimal signal attenuation. The ever-increasing use of high speed computer equipment and telecommunications equipment has increased such demand.

One existing cable product capable of high data rate transmission is fiber-optic cable which has good bandwidth performance over long distances. Furthermore, fiber-optic cables provide very low attenuation and little interference or noise with the transmitted signal. However, despite their desirable signal transmission qualities, fiber-optic cables are still very expensive. Furthermore, when transmission of signals over shorter distances is required, fiber-optic cables become particularly less desirable from an economic standpoint. As a result, for high speed data transmission over relatively short distances, such as up to 50 meters, copper based, differential signal transmission cables are the predominant choice in the industry.

Differential signal transmission involves the use of a cable having a pair of individual conductors wherein the information or data which is transmitted is represented by a difference in voltage between the individual conductors. The data is represented in transmission by polarity reversals on the conductor pair, and the receiver or other equipment coupled to the receiving end of the cable determines the relative voltage difference between the conductors. The difference is then analyzed to determine its logical value, such as a 0 or 1. Differential pairs may be shielded or unshielded. Shielded differential pairs generally perform better than unshielded pairs because the internal and external environments of the conductors are isolated. Improved attenuation performance also usually results with shielded cables.

Differential signal transmission cables have a variety of desirable electrical characteristics, including immunity to electrical noise or other electrical interferences. Since the differential signals transmitted are generally 180° out of phase to provide a balanced signal in the cable, and are considered to be complementary to one another, any noise will affect both of the conductors equally. Therefore, the differences in the signals between the conductors of the pair due to external electrical noise and interference are generally negated, particularly for shielded pairs. It may also be true for unshielded differential pairs as well by varying the twisting of the pairs, for example. It is common to twist the individual conductors of a pair together along the longitudinal axis of the pair. The cables are then referred to as twisted pair cables. The main advantage of such cables is increased mechanical flexibility. However, there are considerable disadvantages to twisted pair cables; two important ones being size increase and high group skew.

Differential signal transmission cables are also generally immune to cross-talk, that is, interference between the individual cables due to the signals on other cables which are bundled together into a multi-cable, or multi-pair, structure. Again, shielded differential pairs will generally outperform unshielded pairs with respect to cross-talk. The multiple differential signal cables bundled together into a larger overall cable structure are referred to as primary cables of the overall, larger cable construction.

Since differential signal transmission relies upon parallel transmission of the data signals through the conductors of a pair, and then comparison of the differences between those signals at the receiving end of the cable, it is desired that the complementary signals of each pair arrive at the receiving end of the cable at the same time. However, properties of the cable affect the propagation speed of the signals along the conductors and therefore introduce delays between the signals of a differential pair. For example, because of insulative property differences experienced by each conductor of a cable pair, such as differences due to dielectric inconsistencies and/or physical characteristics of the cable, differential signal transmission cables are subject to propagation differences between the individual conductors. Variances in the effective length of one conductor with respect to the other conductor of a pair also create such differences. The difference in signal propagation between the conductors of a differential pair and the delays associated therewith is referred to as signal skew. Signal skew is defined as the delay of the arrival of one of the corresponding or complimentary signals at the receiving end with respect to the other signal. In simpler terms, one complimentary signal arrives at the receiving end faster than the other signal, a condition which is exaggerated as cable length increases. Generally, a signal skew budget is designed into data transmission systems and the cables which link the systems are allowed only a portion of the budget.

Within a single differential pair, the skew is determined between the two individual conductors of the pair and is referred to as within-pair skew. In some cable applications, multiple differential pairs are bundled together to form a larger overall cable. Skew is then measured for each pair as a time delay for the differential balanced signal of the cable pair. The measure of time difference between the fastest and slowest signals for each of the multiple pairs, with each pair being considered to provide a single signal, is defined as a pair-to-pair or group skew.

More specifically, with a signal of one conductor considered $M_1$, and the signal of another conductor considered $M_2$, a differential pair will have a propagation delay associated not only with each signal $M_1$, $M_2$ individually, but also with the propagation of the differential balanced signal $(M_1-M_2)$. The differential balanced signal takes into account the differences in potential along the length of the whole line, the reference limit being zero. As differences in the individual conductors are encountered, each individual conductor of a pair contributes different potentials to the $(M_1-M_2)$ balanced signal. The $(M_1-M_2)$ signal fluctuates about zero. The group skew measurement is then the time delay difference between the fastest differential signal $(M_1-M_2)$ and the slowest of such signals in a group of pairs in a multi-pair cable. That is, $(M_1-M_2)$ is measured for each pair in a multi-pair cable and then the difference between the maximum time delay and the slowest time delay defines group skew.

Therefore, within-pair and group signal skews are important parameters which must be considered when using a differential signal transmission cable which incorporates multiple differential pairs. As will be appreciated, it is desirable to keep the in-pair signal skew characteristics of a cable to a minimum to prevent errors in communication. Furthermore, low signal skew is necessary for proper cancellation of noise, because if the two opposing signals do not arrive at the receiving end at the same time, a certain amount of the noise in the cable will not be cancelled.

Another important characteristic for a differential signal cable is signal jitter. Signal jitter is defined as the amount of real time it takes for the differential signals' rising and falling edges to cross over when they transition. Low jitter, or rapid rising and falling edges, is desirable.

Attenuation should also be minimized in a differential cable. All cables will inherently reduce or attenuate the level of the signal transmitted thereon, due to the impedance qualities of the cable. Attenuation is generally affected by the physical structure of the cable, which includes the shield type and design, the dielectric insulation material type, the conductor type, plating type and plating thickness, the position of the conductors with respect to each other, and the electrical interaction between the conductors of the cable. If the primary cables or primaries of a larger multi-paired cable are poorly constructed, the dielectric insulation properties, conductor-to-dielectric geometry, and hence impedance characteristics, may vary along their length. The variation of such impedance characteristics increases the signal attenuation or loss characteristics of the cable. However, attenuation of a test pattern signal, or eye pattern, should be sufficiently low so that suitable triggering voltages will be available at the output of the cable. Accordingly, it is desirable to utilize a cable which has low attenuation characteristics at a desired operating frequency for that cable.

Low within-pair and group skew, low jitter and high signal amplitude (low attenuation) are all desirable characteristics of a differential cable, and improving those characteristics allows a differential signal transmission cable to be utilized at greater lengths or distances. It is therefore desirable to utilize a data transmission cable having a relatively low signal skew, low jitter and low attenuation.

In one aspect of cable design, it is desirable to improve the performance characteristics of a differential cable pair or primary pair. However, multi-pair cables for certain applications use multiple pairs or multiple primary cables which are then bundled together under a common insulative jacket and/or shield. In such a construction, the primaries affect each other, and it is not sufficient to simply design a primary which has desirable characteristics by itself and place it into a bundle with other similar primaries. Rather, the multi-pair cable design must also have the desirable characteristics. That is, a multi-pair cable has its own performance characteristics and criteria which are not dictated solely by the performance of the primaries therein.

Accordingly, it is an objective of the present invention to provide a high-speed data transmission cable which has improved performance characteristics.

It is further desirable to provide such improved performance characteristics in a multi-pair cable.

It is another objective of the invention improve the group skew, within-pair skew, jitter and attenuation characteristics of data transmission cable, and specifically to improve such characteristics for a multi-pair cable.

It is still a further objective of the present invention to provide a high-speed data transmission cable which can be used at greater lengths than the present high speed data cables.

SUMMARY OF THE INVENTION

A high speed data transmission cable in accordance with the present invention is comprised of a plurality of primary cables formed together into a larger overall cable structure. Each primary cable includes a pair of generally parallel conductors which are individually insulated, such as with an extruded insulation. The pair of conductors are placed side-by-side and, in one embodiment, an overall layer of insulation simultaneously surrounds the pair of conductors to form the primary cable. In one aspect of the present invention, the overall insulation might be formed by utilizing an unsintered PTFE tape which is wrapped around the pair of conductors. Alternatively, an overall insulation layer may not be used. The primary cable which is formed has opposing short sides and long sides. A shield layer surrounds the overall insulation layer along the length of the cable, to individually electrically isolate the primary cables from each other when they are bundled together. For example, a polyester/metal tape such as PET/aluminum tape, might be wrapped around the primary cable to form the shield. A drain wire might be positioned between the shield layer and the overall insulation layer for grounding the cable.

In accordance with another aspect of the present invention, a plurality of primary cables are positioned around the cable center axis, which may be defined by an elongated plastic insert. A finite number of primary cables are arranged side-by-side with each other and generally parallel with each other to define distinct orbitals around the center axis. The primary cables of the orbitals are positioned to lie generally flat against the center of the cable. That is, a respective long side of each primary cable will generally be facing the center axis. Multiple orbitals are formed around the center axis. In one embodiment of the invention, the primary cables are utilized in a three-orbital construction.

The primary cables of the orbitals, after being arranged in a side-by-side orientation, are wrapped generally helically around the center axis along the length of the cable. Each primary cable remains side-by-side with adjacent primary cables and generally flat around the center axis of the cable, and the conductor pairs of the cable are not significantly individually twisted about each other along the length of the cable. That is, the present invention utilizes flat, primary cables with generally parallel conductors and not twisted conductor pairs.

The overall cable is formed by surrounding the orbitals and the helically wrapped primary cables with an overall shield layer, such as a wrapped polyester/metal tape layer. A metal braid layer is then utilized to surround the overall shield layer. An overall layer of insulation, such as a jacket of insulation, is used to complete the cable.

The unique construction of the present invention has been found to provide desirable within-pair and group skew, jitter, attenuation and other performance characteristics within high speed data transmission applications. These advantages and other advantages will become more readily apparent in the detailed description here and below.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
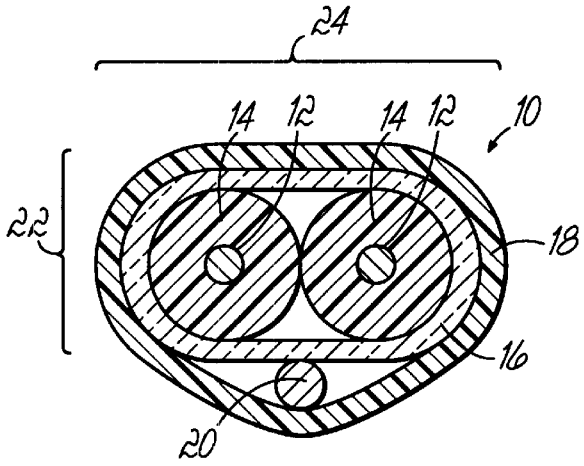
FIG. 1 is a cross section of view of one embodiment of a primary cable in accordance with the principles of the present invention.

FIG. 1 illustrates the cross-sectional view of a primary cable utilized in the high speed data transmission cable of the present invention. Primary cable 10, is comprised of a pair of metal conductors 12 (e.g. copper), which are each individually insulated and surrounded by an insulation layer 14. The insulation layer 14 may be any suitable insulation such as an extruded foam polyethylene. In the embodiment of FIG. 1, the conductors 12 are shown to be insulated by separate layers 14. However, an alternative embodiment might utilize a common insulation structure which simultaneously surrounds both conductors 12, such as one having a figure eight cross-section. One example of a suitable primary is illustrated in U.S. Pat. No. 6,010,788, which is incorporated herein by reference in its entirety. A second or overall layer of insulation 16 simultaneously surrounds the pair of conductors 12 and associated insulation 14. Insulation layer 16 holds the conductors 12 together generally parallel to each other along the length of the cable to form the primary cable 10. Insulation layer 16 may be formed of a suitable insulative material. In one embodiment of the invention, an unsintered PTFE is used. For example, the unsintered PTFE may be in the form of a tape which is wrapped around the conductors 12 to form a continuous layer 16.

Figure 1A:
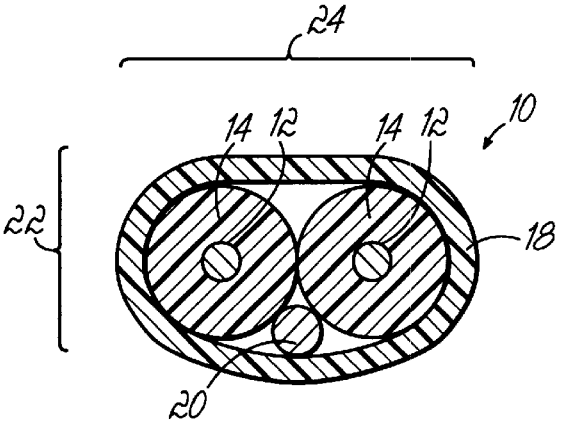
FIG. 1A is a cross-section of another embodiment of a primary cable in accordance with the principles of the present invention.

FIG. 1A illustrates another embodiment of a primary cable 10 which might be utilized in the present invention. Therein, the metal conductors 12 and insulation layers 14 are not overwrapped with PTFE prior to being shielded by shield layer 18 as described below. Primary cable 10*a* could be formed with or without a drain wire 20.

For an overall cable in accordance with the present invention using a primary as shown in FIG. 1A, and primary pair counts from 8 to 26, the group skew characteristics were similar to those of cables using the primary cable design of FIG. 1 (e.g. 5–10 ps/ft). However, because the dielectric properties are better with overwrapped primaries, attentuation and jitter characteristics, using the primary of FIG. 1 A, were not as low as with cables using the primary design of FIG. 1.

The cable is then shielded with a shield layer 18 that surrounds each primary cable along its length. The shield layer (18) individually electrically isolates each of the primary cables from each other when they are positioned with other primary cables in the overall cable structures as illustrated in FIGS. 2 and 3, and discussed further hereinbelow.

In one embodiment of the invention, the shield layer 18, comprises a polyester layer and a metal layer, adjacent to at least one side of the polyester layer. Shield layer 18 may take the form of a tape, including such polyester and metal components, which is then wrapped, in an overlapped fashion, around the cable to form a continuous metal shield. One suitable polyester layer for the shield layer is PET, such as Mylar™. A suitable metal layer for the shield layer is aluminum. Several suitable examples of shield layers are illustrated in U.S. Pat. No 6,010,788. A drain wire 20 may or not be wrapped with the cable underneath the shield in conventional fashion. Although the drain wire 20 is shown somewhat larger and therefore bulging from the side of the cable column in the cross-section of FIG. 1, it would generally be less pronounced in reality.

The finished primary cable generally has opposing short sides 22 and opposing long sides 24 and forms what might be loosely considered an oval cross section. Herein, the long sides 24 and the short sides 22 of the cable cross-section will be utilized in describing the positioning of the primary cables within the overall data transmission cable of the present invention.

Figure 2:
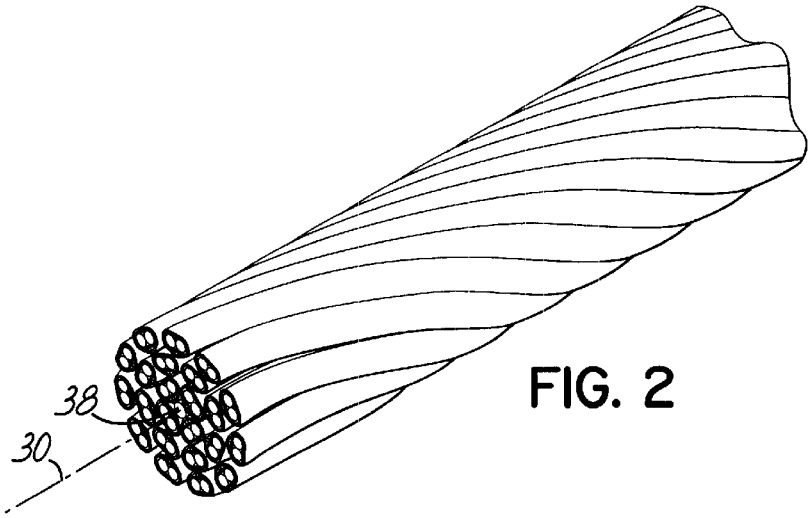
FIG. 2 is a prospective cross sectional view of a multi-pair cable formed in accordance with the principles of the present invention.
Figure 3:
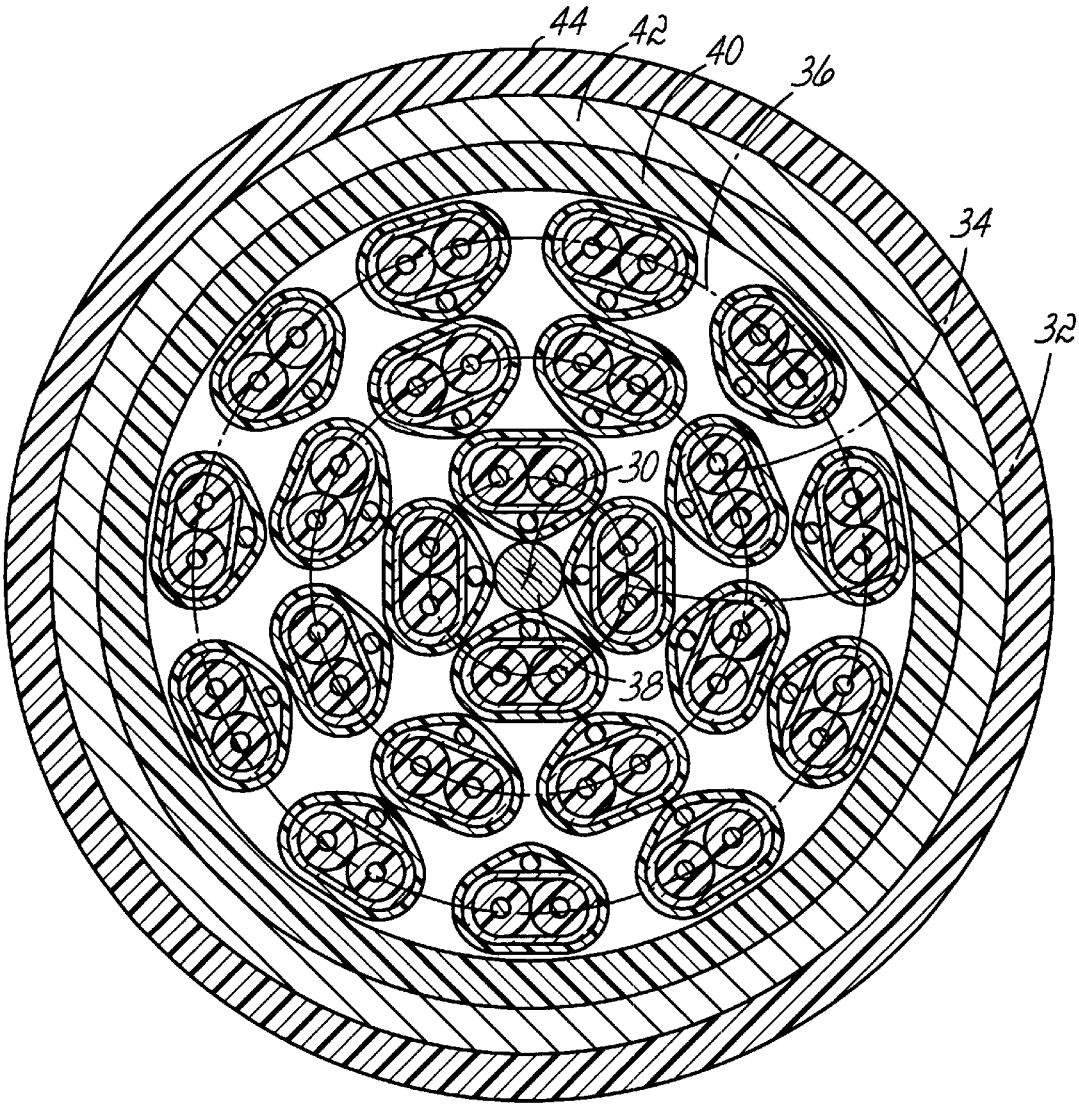
FIG. 3 is a cross sectional view of the multi-pair cable formed in accordance with the principles of the present invention.

In accordance with one aspect of the present invention, a plurality of primary cables, similar to cable 10 are positioned around the cable center axis 30, as illustrated in FIG. 2. A finite number of primary cables are arranged side-by-side with each other with the short sides facing to define distinct orbitals around the center axis. Referring to FIG. 3, illustrative orbital lines 32, 34 and 36 are shown for illustrating the distinct orbitals formed by the primary cables, which are arranged side-by-side with other primary cables around the cable center axis 30. Line 32 illustrates an innermost orbital, line 34 illustrates a middle orbital, and line 36 illustrates an outermost orbital in the embodiment shown in FIG. 3. When arranged in the orbitals as illustrated in FIG. 3, the primary cables 10 have respective long sides 24, which generally face radially inwardly toward the center axis 30, or face radially outwardly. In one embodiment of the invention, the center axis 30 may be formed by a plastic insert 38 which extends along the length of the cable. The embodiment illustrated in the Figures is shown with three distinct orbitals. However, a greater or smaller number of orbitals might be utilized. Furthermore, the number of primary cables in each orbital might be varied from that shown in the Figures.

In accordance with another aspect of the present invention, the primary cables of the orbitals, 32, 34, and 36, are arranged in a side-by-side orientation, generally helically around the center axis along the length of the cable, without each primary cable conductor pair being significantly individually twisted along the primary cable length. That is, while the primary pairs are helically wrapped around center axis 30 within their defined orbitals, the primary cables are not twisted pairs in the conventional meaning of such a term. To that end, generally along the length of the cable, the respective long side of each primary cable facing the center axis will remain facing the center axis, as the primary cable traverses the length of the cable, even though the primary cable is wound helically around the center axis. Also, the short sides 22 of adjacent primary cables will generally remain facing each other. That is, the primary cables are not individually twisted pairs in the inventive cable. Furthermore, the adjacent pairs generally maintain a similar orientation with respect to each other as they wind helically around the cable center longitudinal axis. This is referred to as parallel lay with respect to the individual primary cables.

In one embodiment of the invention, each of the orbitals may be helically twisted in the same direction, e.g., the clockwise direction. Furthermore, the orbitals may have similar lay lengths. Alternatively, at least one of the defined orbitals might be helically wrapped generally independently of the helical wrapping of another orbital. That is, one orbital may have either a different twist direction or a different lay length than another of the orbitals within the overall cable.

Once the various orbitals are formed and defined utilizing the primary cables, the plurality of primaries are further bound to complete the overall cable. For example, an overall shield layer 40, is formed around the helically wrapped primary cables. A suitable shield layer could be similar to shield layer 16 discussed above and may comprise a polyester metal tape, such as a PET/aluminum tape, which is wrapped around the outermost orbital of the cable. A braid layer 42, such as a tinned copper layer, is then formed around the overall shield layer 40. The braid layer 42 essentially forms a second overall shield layer. Finally, a jacket layer 44 of a suitable insulation, such as extruded polyethylene or PVC, is formed on the outside of the braid layer and shield layer to complete the cable.

Within the cable as illustrated in FIGS. 2 and 3, the primary cables are laid down generally next to each other and are not individually twisted. The helical wrapping maintains the primary cables generally parallel to each other with certain of the long sides of the cables facing radially inwardly toward the center of the cable axis, and others of the long sides facing radially outwardly. The inventor has found that the design of the cable provides a considerable amount of manufacturing margin and that the performance of the overall cable is not deteriorated when cabling the pairs together in such a construction. Furthermore, the inventive cable was found to have desirable skew, jitter and attenuation characteristics.

Typically, for a twisted pair cable of 17–18 pair count, the in-pair skew may be around 20 ps/ft, and group skew may be around 50 ps/ft. The present invention utilizing the parallel lay cables with a similar pair count will preserve the performance of the individual pairs before cabling. It is generally typical with the inventive cable to achieve 5 ps/ft in-pair skew and 10 ps/ft group skew.

Specifically, for certain data transmission cable applications, the group skew is specified at 15 ps/ft (10 ps/ft desired) and within-pair skew is specified at 3.5 ps/ft. Further sample cables of the present invention achieved group skew of 5 ps/ft and in-pair skew of 2 ps/ft or better, with maximum in-pair skew measured to be 3.3 ps/ft.

Another key specification for high speed data transmission cables is jitter. Defined for 10 meter lengths of 26 awg, 105 Ω cable pair, a specification of approximately 220 ps per 10 meters is desirable. The inventive cable is measured to produce approximately 170 ps per 10 meters at the specified frequency of 1 GBPS (500 MHz). Therefore, the cable of the invention has desirable skew and jitter characteristics. Furthermore, the inventive cable also had desirable attenuation characteristics.

Formation of the cable preferably begins with foamed polyethylene pairs of conductors, which are constructed to very exacting tolerances. The pair of polyethylene covered conductors are then overwrapped with full density PTFE unsintered tape of appropriate width, thickness and overwrap. In one embodiment of the invention, a three-eighths inch wide and 0.003 inch thick tape was utilized with a 50% overlap, although other tapes, widths, thicknesses, overlaps may be utilized in accordance with the principles of the present invention. The electrical characterization of the primary cable pairs is then determined to match the pairs within the cable based upon performance.

All pairs are characterized by measuring $Z_o$, $T_d$ and skew at each end off all of the pairs. The inventive cable primaries should not have greater than 2 Ω impedance differences, greater than 5 ps/ft group skew, and greater than 1 ps/ft in-pair skew before cabling. Lay up of the primaries into the cable is commenced. During cabling, further measurements are taken and no primary pair is allowed to exceed the specification requirements, typically 4–6 ps/ft in-pair skew and 15 ps/ft group skew.

Cabling is performed to fabricate the various orbitals or layers of the cable with the appropriate lay or pitch to the helical wrapping. The pitch of the helical wrapping is particularly important for group skew. It appears the primary cable pairs of the orbital must be maintained generally flat around the orbital, that is, with a respective long side facing radially inwardly toward the center axis, for proper within-pair skew characteristics. To that end, the motion of the primary cables over the guides, rollers and pulleys of the cabling equipment should be determined for the primary pairs to maintain them generally flat within the orbitals, as illustrated in FIGS. 2 and 3, to obtain lowest skew characteristics. Polyester/metal shield 40 is then applied along with the braid layer 42, which may be tinned copper. Finally, a suitable insulated jacket was formulated to be utilized over the cable. One suitable layer diameter is 0.515 inches for an outer jacket.

In determining the performance characteristics of the inventive cable, the individual primary pairs were tested for impedance, skew, and time delay utilizing the TEK 11802 TDR. The Tektronix 11802 (time domain reflectometer) is used to measure cable response to a signal in real time. $Z_o$, $T_d$ and skew are direct measurements; $Z_o$ in Ω, $T_d$ in ns and skew in ps. Attenuation is measured with an Anritsu 360 or HP/Agilent 8720ES VNA, (vector network analyzer). The pairs are then tested for attenuation at specified frequencies, normalized to 100 feet. Differential eye diagrams are generated for each pair at a specified frequency using appropriate input from an ANRITSU 8163 pulse generator, and received and displayed on a TEK 11801 TDR. The eye diagrams for each pair determine the output amplitude (equivalent to a circuit triggering voltage) and jitter (equivalent to the crossover of the rising and falling edges) in terms of time, typically in picoseconds (ps). Lower jitter and higher output amplitude is desired for any given length and wire gauge size.

In the design of the inventive cable, the polyethylene insulated conductors, which may or may not be flame retardant, are protected by PTFE tape. The tape insulation layer 16 also serves to increase the distance between the conductors and shield layer 18 in the primary pair. This enhances the skew characteristics of the cable. Also, attenuation is reduced by introducing PTFE under the shield, primarily because PTFE is a material with excellent dielectric properties. With lower attenuation in the inventive cable, a higher amplitude in differential eye diagram and lower jitter results. Insulated PTFE tape wrapped around the conductor pair also serves to lock the pair of conductors against each other and reduces component motion during cabling. In that way, desirable skew performance, both for within-pair skew and for group skew, is maintained during cabling of the pairs together into the overall multi-pair cable.

To form the insulation layer 16, other insulation materials may be utilized. For example, low density Teflon™ tape, Mylar™ tape, and paper tape may be used. The inventor has found that full density, unsintered PTFE tape is a desirable material because of its toughness, low dielectric constant, and gummy or sticky quality, which assists in locking the insulation layer 16 around the conductors 12. Table 1 below sets forth the test results for one embodiment of the invention.

TABLE 1

| | | |
|---|---|---|
| Sample Length | | 35.5 feet |
| $Z_0$ | | 104.3–106.3 Ω |
| Groupskew | | 8.5 ps/ft |
| Within-pair skew | | 3.4 ps/ft (2 pairs at this level) |
| Jitter | | 174 ps (+/− 6 mVmask) |
| Attenuation | .100 Gig | −7.13 db/100' |
| | .2 | −9.75 db |
| | .4 | −14.0 db |
| | .5 | −15.58 db |
| | 1.0 | −23.83 db |
| | 1.5 Gig | −29.86 db |
| Eye Pattern amplitude at sample length (10.6 meters} ~~ 470 mV | | |

FIG. 1 illustrates one embodiment of the invention utilizing a design encompassing 23 primary pairs. The first orbital includes four pairs, the second orbital includes eight pairs, and finally, the outermost orbital 36 includes 11 pairs. In another aspect of the invention, 20–25 pairs may be formed into the cable. Alternatively, a greater number of primary pairs may be utilized and a number of orbitals greater or lesser than three may also be utilized. Therefore, the present invention is not limited to the exact embodiment as illustrated in FIGS. 1–3.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A high speed data transmission cable comprising:

a plurality of primary cables, wherein each of said primary cables includes a pair of generally parallel, insulated conductors, and each primary cable having opposing short sides and opposing long sides;

a shield layer surrounding each of said primary cables along its length to individually electrically isolate the primary cables from each other;

the plurality of primary cables being positioned around a cable center axis with finite numbers of primary cables arranged side-by-side with each other to define distinct orbitals around the center axis, the primary cables of the orbitals having a respective long side generally facing radially inwardly toward the center axis;

the primary cables of the orbitals being wrapped generally helically around the center axis along the length of the cable without each primary cable conductor pair being significantly individually twisted about each other along the cable length.

2. The cable of claim 1 wherein at least one of the primary cables further comprises an overall layer of insulation simultaneously surrounding the pair of insulated conductors which form the at least one primary cable.

3. The cable of claim 1 wherein said shield layer comprises a polyester layer and a metal layer adjacent at least one side of the polyester layer.

4. The cable of claim 3 wherein the polyester layer includes PET.

5. The cable of claim 3 wherein the metal layer includes aluminum.

6. The cable of claim 3 wherein the layer of metal is positioned between the polyester layer and the respective primary cable.

7. The cable of claim 3 wherein the shield layer is formed by a shield tape wrapped in an overlapping fashion around the respective primary cable.

8. The cable of claim 1 further comprising a drain wire positioned with at least one of the primary cables beneath the shield layer.

9. The cable of claim 1 further comprising a plastic insert generally defining the center axis of the cable.

10. The cable of claim 1 further comprising an overall shield layer surrounding the plurality of primary cables.

11. The cable of claim 10 further comprising a braid layer surrounding the overall shield layer.

12. The cable of claim 11 further comprising a jacket layer surrounding the braid layer.

13. The cable of claim 2 wherein the overall layer of insulation surrounding each of the primary cables is unsintered PTFE.

14. The cable of claim 13 wherein said unsintered PTFE is in the form of a tape and is wrapped around the at least one primary cable.

15. The cable of claim 1 wherein said primary cables are arranged in at least two orbitals, the primary cables of an outer orbital lying generally flat with a respective long side against an inner orbital.

16. The cable of claim 1 wherein at least one defined orbital is helically wrapped generally independently of the helical wrapping of another orbital.

17. The cable of claim 1 wherein at least one defined orbital is helically wrapped with a different lay length than the helical wrapping of another orbital.

18. The cable of claim 1 wherein at least one defined orbital is helically wrapped in a different direction than the helical wrapping of another orbital.

19. The cable of claim 1 wherein at least one defined orbital is helically wrapped in generally the same direction and lay length as the helical wrapping of another orbital.

20. The cable of claim 1 further comprising approximately 20 to 30 primary pairs formed into the cable.

21. The cable of claim 1 comprising three distinct orbitals of primary cables, an innermost orbital including four pairs of primary cables, a middle orbital including eight pairs of primary cables, an outermost orbital including eleven pairs of primary cables.

22. A method of forming a high speed data transmission cable comprising:

assembling a plurality of primary cables, each primary cable including a pair of generally parallel, insulated conductors, and each primary cable having opposing short sides and opposing long sides;

surrounding each primary cable along its length with a shield layer to individually electrically isolate the primary cables from each other;

positioning the plurality of primary cables around a cable center axis with finite numbers of primary cables arranged side-by-side with each other to define distinct orbitals around the center axis, the primary cables of the orbitals being positioned to have a respective long side generally facing radially inwardly toward the center axis;

wrapping the primary cables of the orbitals generally helically around the center axis along the length of the cable while preventing each primary cable conductor pair from being significantly individually twisted about each other along the cable length.

23. The method of claim 22 further comprising positioning an overall layer of insulation to simultaneously surround the pair of insulated conductors which form the at least one primary cable.

24. The method of claim 22 wherein said shield layer comprises a polyester layer and a metal layer adjacent at least one side of the polyester layer.

25. The method of claim 24 further comprising positioning the layer of metal between the polyester layer and the respective primary cable.

26. The method of claim 22 further comprising positioning a drain wire with at least one of the primary cables beneath the shield layer.

27. The method of claim 22 further comprising positioning an overall shield layer to surround the plurality of primary cables.

28. The method of claim 27 further comprising positioning a braid layer to surround the overall shield layer.

29. The method of claim 28 further comprising positioning a jacket layer to surround the braid layer.

30. The method of claim 22 further comprising arranging said primary cables in at least two orbitals, the primary cables of an outer orbital being positioned to lie generally flat with respective long sides against an inner orbital.

31. The method of claim 22 further comprising helically wrapping at least one defined orbital generally independently of the helical wrapping of another orbital.

32. The method of claim 22 further comprising helically wrapping at least one defined orbital with a different lay length than the helical wrapping of another orbital.

33. The method of claim 22 further comprising helically wrapping at least one defined orbital in a different direction than the helical wrapping of another orbital.

34. The method of claim 22 further comprising helically wrapping at least one defined orbital in generally the same direction and lay length as the helical wrapping of another orbital.

35. The method of claim 22 further comprising forming approximately 20 to 30 primary pairs into the cable.

36. The method of claim 22 further comprising forming three distinct orbitals of primary cables, including forming an innermost orbital including four pairs of primary cables, a middle orbital including eight pairs of primary cables, an outermost orbital including eleven pairs of primary cables.

37. A method of transmitting a plurality of high speed differential data signals over a transmission cable comprising:

directing said plurality of differential data signals into a plurality of primary cables, each primary cable including a pair of generally parallel, insulated conductors, and each primary cable having opposing short sides and opposing long sides;

isolating the primary cables and corresponding differential data signals from each other by shielding each primary cable along its length with a shield layer;

positioning the plurality of primary cables around a cable center axis with finite numbers of primary cables arranged side-by-side with each other so that the differential signals are transmitted in distinct orbitals around the center axis, the primary cables of the orbitals having a respective long side generally facing radially inwardly toward the center axis;

helically wrapping the primary cables of the orbitals around the center axis along the length of the cable and preventing each primary cable conductor pair from being significantly individually twisted about each other along the cable length so that the differential signals are not transmitted along a series of twisted pairs of conductors.

38. The method of claim 37 further comprising insulating the primary cables and respective differential data signals by surrounding the conductors of each primary cable with an overall layer of insulation.

39. The method of claim 37 further comprising shielding the primary cables with a shield layer comprising a polyester layer and a metal layer adjacent at least one side of the polyester layer.

40. The method of claim 37 further comprising positioning a drain wire in the primary cable beneath the shield layer.

41. The method of claim 37 cable of claim 1 further comprising transmitting the differential data signals in at least two orbitals wherein the primary cables of an outer orbital lie generally flat with respective long sides against an inner orbital.

42. The method of claim 37 further comprising transmitting at least some of the differential data signals in one defined orbital which is helically wrapped generally independently of the helical wrapping of another orbital in which other of the differential signals are transmitted.

43. The method of claim 37 further comprising transmitting at least some of the differential data signals in one defined orbital which is helically wrapped with a different lay length than the helical wrapping of another orbital in which other of the differential signals are transmitted.

44. The method of claim 37 further comprising transmitting at least some of the differential data signals in one defined orbital which is helically wrapped in a different direction than the helical wrapping of another orbital in which other of the differential signals are transmitted.

45. The method of claim 37 further comprising transmitting at least some of the differential data signal in one defined orbital which is helically wrapped in generally the same direction and lay length as the helical wrapping of another orbital in which other of the differential signals are transmitted.

* * * * *